US010383795B2

(12) United States Patent
Reed

(10) Patent No.: US 10,383,795 B2
(45) Date of Patent: Aug. 20, 2019

(54) BUBBLE FORMATION INHIBITING VENT ASSEMBLY FOR A VENTED BOTTLE ASSEMBLY

(71) Applicant: Handi-Craft Company, St. Louis, MO (US)

(72) Inventor: Mark D. Reed, Columbia, IL (US)

(73) Assignee: Handi-Craft Company, St. Louis, MO (US)

( * ) Notice: Subject to any disclaimer, the term of this patent is extended or adjusted under 35 U.S.C. 154(b) by 0 days.

(21) Appl. No.: 15/725,531

(22) Filed: Oct. 5, 2017

(65) Prior Publication Data

US 2018/0104155 A1 Apr. 19, 2018

Related U.S. Application Data

(60) Provisional application No. 62/409,459, filed on Oct. 18, 2016.

(51) Int. Cl.

| | |
|---|---|
| ***A61J 11/04*** | (2006.01) |
| ***A61J 9/04*** | (2006.01) |
| ***A61J 11/00*** | (2006.01) |
| ***A61J 9/00*** | (2006.01) |

(52) U.S. Cl.

CPC ..... *A61J 9/04* (2013.01); *A61J 9/006* (2013.01); *A61J 11/008* (2013.01); *A61J 11/04* (2013.01)

(58) Field of Classification Search

CPC ..... A61J 9/04; A61J 11/04; A61J 11/08; A61J 11/02

USPC ..... 215/11.5; 239/33; 220/705, 709, 714, 220/745

See application file for complete search history.

(56) References Cited

U.S. PATENT DOCUMENTS

| | | | | |
|---|---|---|---|---|
| 5,039,012 | A * | 8/1991 | Inaba | A47G 21/18 215/388 |
| 8,684,201 | B2 * | 4/2014 | Berkovitch | A61J 9/04 215/11.4 |
| 2001/0023899 | A1 * | 9/2001 | Hosi | A47G 21/18 239/33 |
| 2004/0089626 | A1 * | 5/2004 | Pyun | A61J 9/006 215/11.5 |

(Continued)

*Primary Examiner* — Sue A Weaver

(74) *Attorney, Agent, or Firm* — Armstrong Teasdale LLP

(57) ABSTRACT

A feeding assembly generally comprises a container having an open top and defining a liquid chamber therein for holding a liquid. A collar assembly defines a closure for the open top of the container upon assembly with the container. The collar assembly includes a collar releasably securable to the container and a nipple coupled to the collar and having an opening through which liquid exits the feeding assembly during feeding. A vent assembly is positionable at least in part on the open top of the container and is configured to facilitate venting of the container to atmosphere as liquid exits the feeding assembly during feeding. The vent assembly is disposed intermediate the container and the nipple and has a vent tube through which air is able to flow from external of the feeding assembly to the container during feeding. The vent tube has an internal rib extending longitudinally of the feeding assembly and is configured to facilitate the flow of liquid from vent assembly back into the container when feeding is ceased and the container is oriented generally upright.

20 Claims, 16 Drawing Sheets

(56) References Cited

U.S. PATENT DOCUMENTS

| | | | | |
|---|---|---|---|---|
| 2005/0236353 | A1* | 10/2005 | Hsu | A61J 9/006 215/11.5 |
| 2008/0217282 | A1* | 9/2008 | Brown | A61J 9/006 215/11.5 |
| 2008/0302793 | A1* | 12/2008 | Tirosh | A47G 19/2272 220/203.17 |
| 2009/0200257 | A1* | 8/2009 | McKendry | A61J 9/04 215/11.5 |
| 2010/0038335 | A1* | 2/2010 | Liang | A61J 9/04 215/11.5 |
| 2014/0180922 | A1* | 6/2014 | Kim | B60L 11/1848 705/44 |
| 2014/0252115 | A1* | 9/2014 | Toepfert | A47G 21/188 239/33 |
| 2016/0106628 | A1* | 4/2016 | Kemper | A61J 9/00 215/11.5 |
| 2016/0354287 | A1* | 12/2016 | Britto | A61J 11/02 |

* cited by examiner

BUBBLE FORMATION INHIBITING VENT ASSEMBLY FOR A VENTED BOTTLE ASSEMBLY

CROSS REFERENCE TO RELATED APPLICATION

This application claims the benefit and priority of U.S. Provisional Application Ser. No. 62/409,459 filed Oct. 18, 2016, entitled "BUBBLE FORMATION INHIBITING VENT ASSEMBLY FOR A VENTED BOTTLE ASSEMBLY," the entirety of which is incorporated herein by reference.

FIELD

The field of this invention relates generally to bottle assemblies and more particularly to a vent insert for a bottle assembly.

BACKGROUND

Bottle assemblies, such as infant or nursing bottle assemblies, typically have multiple components including a bottle, a nipple, a collar for securing the nipple to the bottle (the nipple and collar sometimes collectively defining a collar assembly), and a cap for covering the nipple when the bottle is not in use. The nipple typically has one or more openings for allowing liquid contained within the bottle to exit through the nipple and into an infant's mouth for consumption by the infant (or young child). During use, the infant places an end of the nipple in their mouth and sucks on the nipple to withdraw the liquid contained within the bottle.

At least some bottle assemblies include a removable vent assembly that can be positioned within the bottle. For example, at least some bottle assemblies comprise a removable vent assembly configured to sit on an annular rim defining an open end of the bottle which permits venting of the bottle during use. In these bottle assemblies, the vent assembly allows air to enter the bottle while the infant consumes the liquid through the nipple, thus alleviating or reducing the formation of a vacuum within the bottle during nursing. The vent assembly typically seats, at least in part, on the rim of the bottle and a collar assembly including a collar and nipple are together threadably secured down over the vent assembly to external threads on the neck of the bottle.

The vent assemblies, therefore, are positioned between the bottle and the nipple, and include an air vent feature for venting air from the interior of the bottle to the ambient environment exterior of the bottle assembly. The vent assembly includes a vent tube that extends into the interior of the bottle to a location proximate the bottom of the bottle. In use, the bottle assembly is typically tilted at a downward angle so that the contents of the bottle flow through openings in the vent assembly into the nipple. In addition, a portion of the contents of the bottle flow into the vent tube. The vent tube has a receptacle sized to receive the liquid in the vent tube. When feeding is complete, the bottle is tilted back upright. As such, the liquid remaining in receptacle is intended to flow back through the vent tube and back into the bottle. However, with some known bottles, air may become trapped in the vent tube between the liquid flowing back into the bottle from the receptacle, and the liquid flowing into the vent tube from the bottle, thereby forming an air bubble in the vent tube. The air bubble may prevent the liquid from properly flowing back into the bottle from the receptacle.

When the bottle is used again, the liquid above the air bubble flows back in the receptacle, plus additional liquid in the vent tube flows into the receptacle. As a result, the risk of leakage from the bottle assembly is increased.

There is a need, therefore, for a bottle assembly, and in particular a vented bottle assembly, in which the vent assembly facilitates the flow back of liquid into the bottle when the bottle is turned upright after feeding.

SUMMARY

In one aspect, a feeding assembly generally comprises a container having an open top and defining a liquid chamber therein for holding a liquid. A collar assembly defines a closure for the open top of the container upon assembly with the container. The collar assembly includes a collar releasably securable to the container and a nipple coupled to the collar and having an opening through which liquid exits the feeding assembly during feeding. A vent assembly is positionable at least in part on the open top of the container and is configured to facilitate venting of the container to atmosphere as liquid exits the feeding assembly during feeding. The vent assembly is disposed intermediate the container and the nipple and has a vent tube through which air is able to flow from external of the feeding assembly to the container during feeding. The vent tube has an internal rib extending longitudinally of the feeding assembly and is configured to facilitate the flow of liquid from vent assembly back into the container when feeding is ceased and the container is oriented generally upright

BRIEF DESCRIPTION OF THE DRAWINGS

These and other features, aspects, and advantages of the present disclosure will become better understood when the following detailed description is read with reference to the accompanying drawings in which corresponding characters represent corresponding parts throughout the several views of the drawings.

Figure 1:
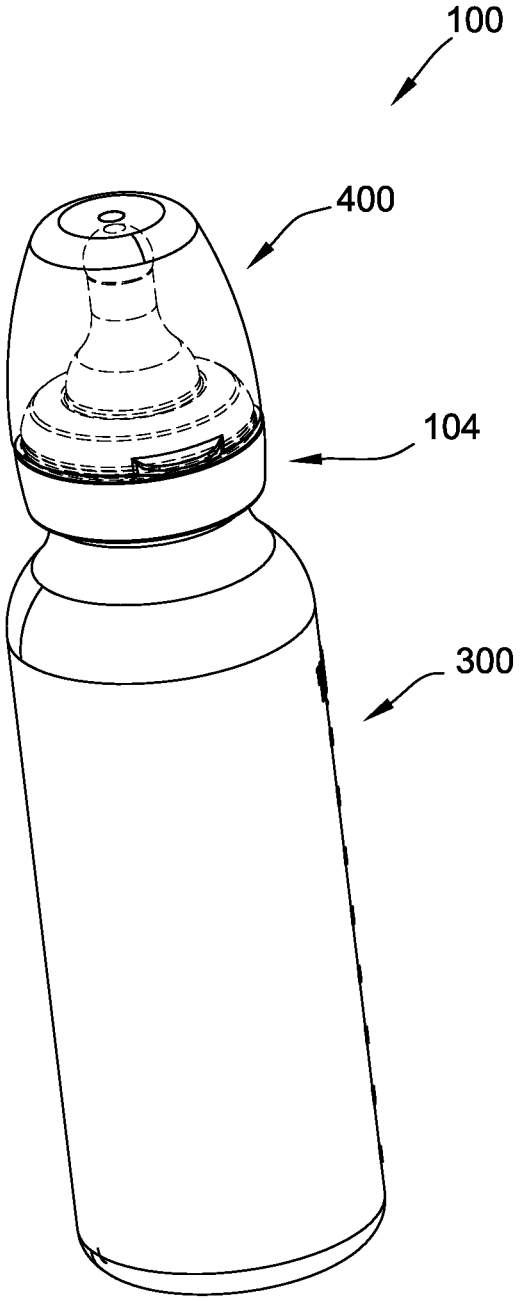
FIG. 1 is a perspective of one embodiment of a nursing bottle assembly.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION OF THE DRAWINGS

In the following specification and the claims, reference will be made to a number of terms, which shall be defined to have the following meanings.

In the following specification and the claims, reference will be made to a number of terms, which shall be defined to have the following meanings. The singular forms "a," "an," and "the" include plural references unless the context clearly dictates otherwise. The terms "comprising," "including," and "having" are intended to be inclusive and mean that there may be additional elements other than the listed elements. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise Referring now to the drawings and in particular to FIGS. 1-3, a feeding assembly or bottle assembly including a vent assembly is indicated generally at 100. The bottle assembly 100 includes a container or bottle 300, a collar assembly 102, and a cover 400. Each one of the bottle 300, collar assembly 102, and cover 400 are indicated generally by their respective reference number. As described with reference to FIGS. 2 and 3, the bottle 300 has a closed bottom 310, an open top 312, and a generally cylindrical sidewall 314 extending between the closed bottom 310 and the open top 312. The generally cylindrical sidewall 314 includes a base portion 316, a top threaded portion 318, a middle portion 320, and an upper portion 322. The middle portion 320 extends between the base portion 316 and the upper portion 322.

Figure 2:
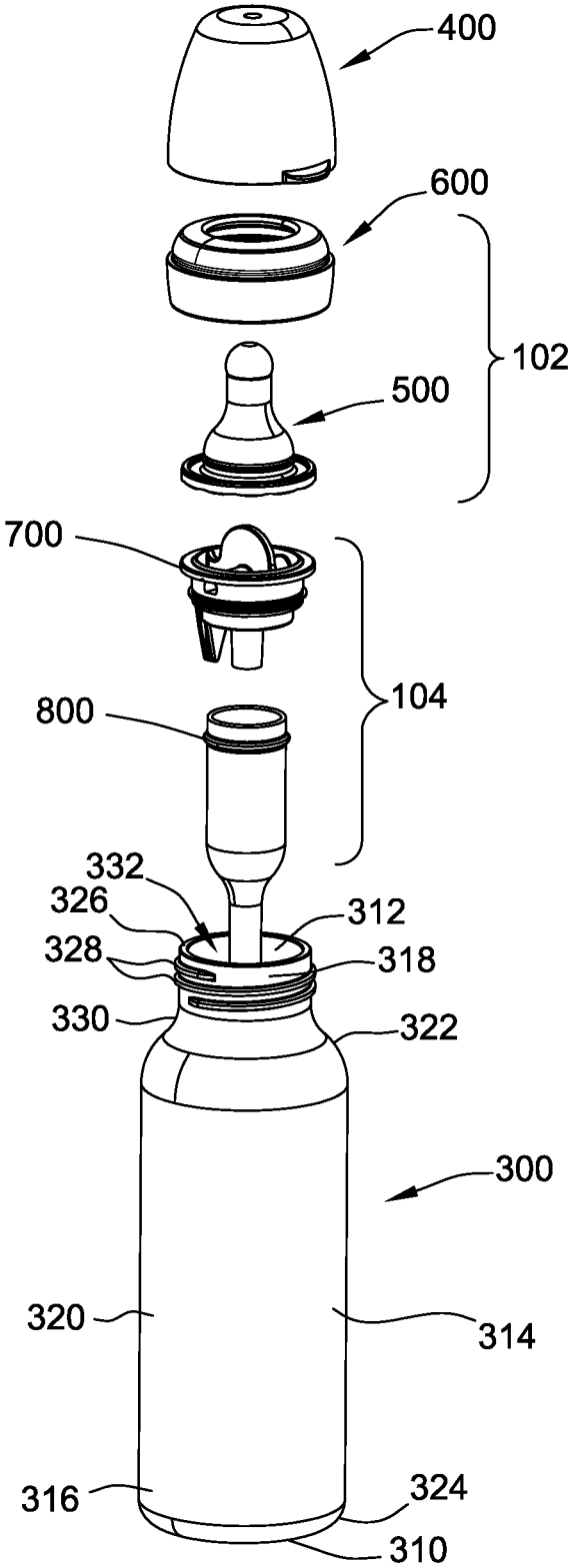
FIG. 2 is an exploded perspective of the bottle assembly shown in FIG. 1.
Figure 3:
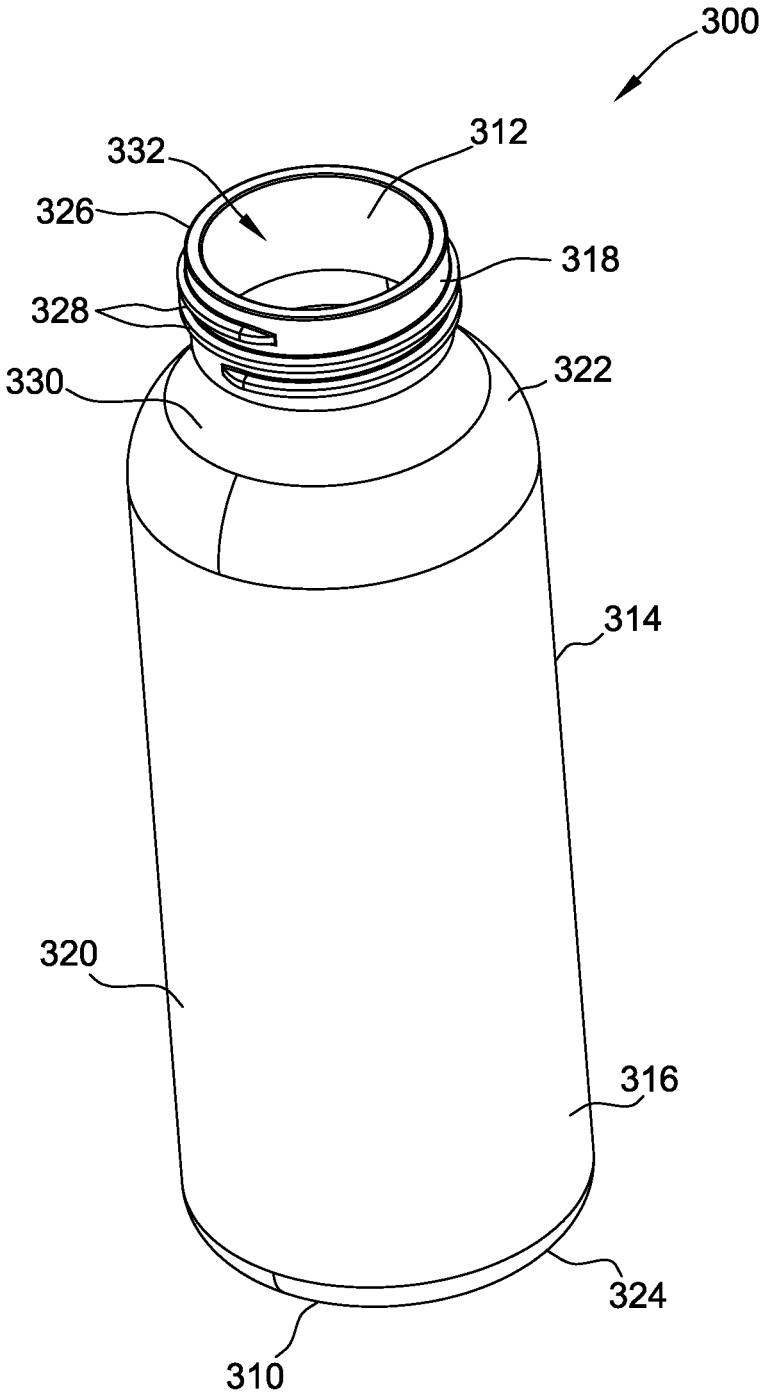
FIG. 3 is a perspective of a container of the nursing bottle assembly of FIG. 1.

With reference to FIGS. 2 and 3, the base portion 316 of the sidewall 314 of the bottle 300 is generally cylindrical and includes a curved lower edge 324 that blends into bottom 310. The top threaded portion 318 of the sidewall 314 is generally cylindrical and has a circular upper edge 326 and external threads 328 spaced below the upper edge 326. External threads 328 facilitate releasably assembling the bottle 300 to the collar assembly 102 as described later herein. In the exemplary embodiment, the top threaded portion 318 of the bottle 300 has a diameter that is less than the diameters of the upper portion 322, the middle portion 320, and the base portion 316. As a result of the difference in diameter, the upper portion 322 has a region 330 that tapers toward the top threaded portion 318. The generally cylindrical sidewall 314 extends vertically between the base portion 316 and the upper portion 322. As a result, the generally cylindrical sidewall 314 has a generally tubular shape. It is understood, however, that the diameters of the threaded, upper, middle, and base portions 318, 322, 320, 316, respectively, can be different diameters or sized other than as illustrated herein.

The exemplary bottle 300 has a liquid chamber 332 configured to hold a quantity of liquid for consumption by a user. More specifically, the bottle 300 is configured for use by an infant and to hold approximately 8 ounces of liquid (e.g., milk, formula, water, etc.). The bottle 300 can be fabricated from any suitable material, for example, plastic, glass, stainless steel, aluminum, etc. In addition, the bottle 300 can be fabricated in any desired color or color combinations, and may be transparent, translucent, or opaque. In one suitable embodiment, the bottle 300 is constructed from plastic and manufactured using an injection molding process, which provides greater control over the sidewall thickness of the bottle as compared to a blow molding process. It is understood that the bottle 300 can have different configurations than those illustrated herein, and may be sized to hold quantities of liquid other than 8 ounces (e.g., 2 ounces, 4 ounces, 6 ounces, 12 ounces, etc.).

Figure 4A:
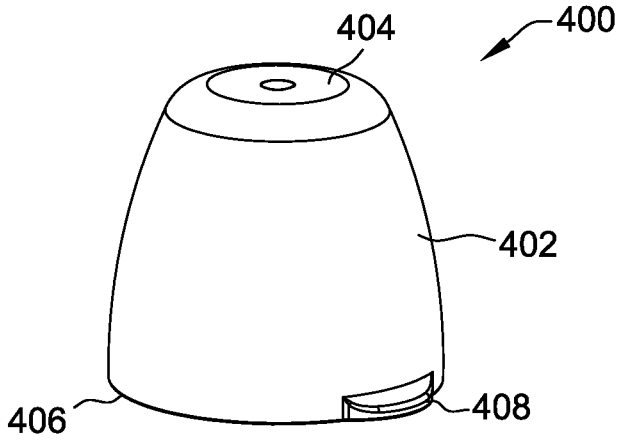
FIGS. 4A and 4B are perspectives of a cover of the nursing bottle assembly of FIG. 1.
Figure 4B:
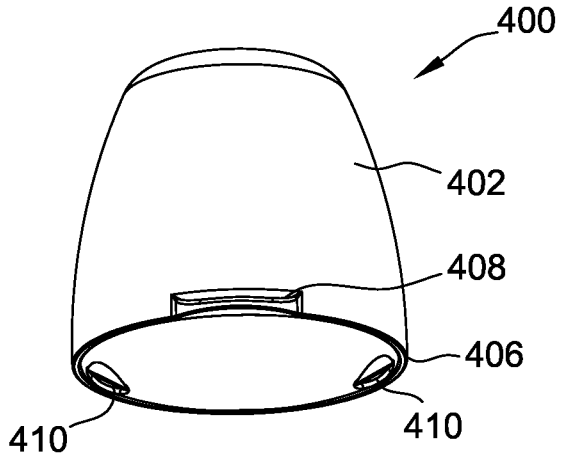
Figure 4C:
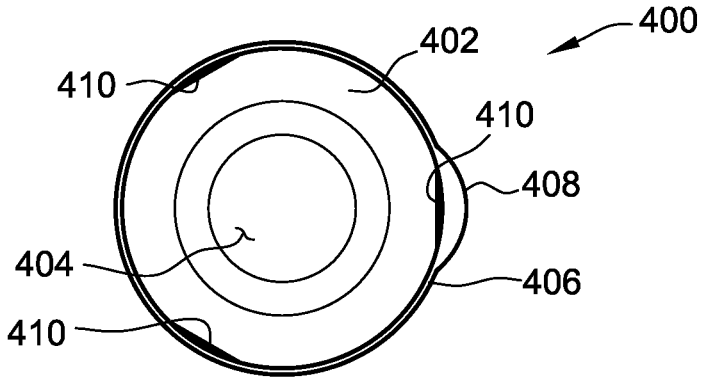
FIG. 4C is a bottom plan view of the cover.

With reference to FIGS. 1 and 2, the cover 400 is removably securable to the collar assembly 102 by a snap-fit connection. It is understood, however, that other types of suitable connections can be used (e.g., a threaded connection). With reference to FIGS. 4A-4C, the cover 400 has a domed body portion 402 and a generally flat top portion 404. The body portion 402 has a lower edge 406 that includes an outward extending semicircular tab 408 configured to facilitate selective removal of the cover 400 from the collar assembly 102. As shown in FIG. 4C, the body portion 402 has three inward extending tabs 410 adapted for releasable snap-fit connection with the collar assembly 102. As a result, the cover 400 can be selectively secured to the collar assembly 102 during periods of non-use of the bottle assembly 100 (e.g., storage, travel, etc.) to cover a nipple 500 (shown in FIGS. 2, 5A, and 5B), and selectively removed during periods of use of the bottle assembly 100 for providing access to the nipple 500. The three tabs 410 are spaced equidistant about the inner surface of the body portion 402. In the exemplary embodiment, the tab 408 is located opposite one of the three inward extending tabs 410. Alternatively, the tab 408 can be located in any position along the lower edge 406 of the body portion 402 that enables the cover 400 to function as described herein.

The cover 400 can be fabricated from any suitable material, such as polypropylene, and can be made in any desired color or color combinations. In addition, the cover 400 can be transparent, translucent, or opaque. It is contemplated that in some embodiments, the cover 400 may be omitted from the bottle assembly 100. It is understood that the cover 400 can have more or fewer inward extending tabs 410 than the three shown in the exemplary embodiment.

With reference to FIG. 2, the collar assembly 102 of the bottle assembly 100 is adapted for removable attachment to the bottle 300 for selectively holding a nipple 500 on the bottle 300. The illustrated collar assembly 102 includes the nipple 500 and a collar 600. The nipple 500 and the collar 600 can each be made of any suitable material. In one embodiment, for example, the nipple 500 is fabricated from a substantially pliable material, for example, and without limitation, a rubber material, a silicone material, or a latex material. It is contemplated, however, that the nipple 500 may be fabricated from any suitable material without departing from the scope of this disclosure. In the exemplary embodiment, the nipple 500 is suitably transparent or translucent but it is understood that the nipple may instead be opaque. In addition, the collar 600 is fabricated from any suitable material, such as polypropylene, and can be made in any desired color or color combinations. Moreover, the collar 600 can be transparent, translucent, or opaque.

Figure 5A:
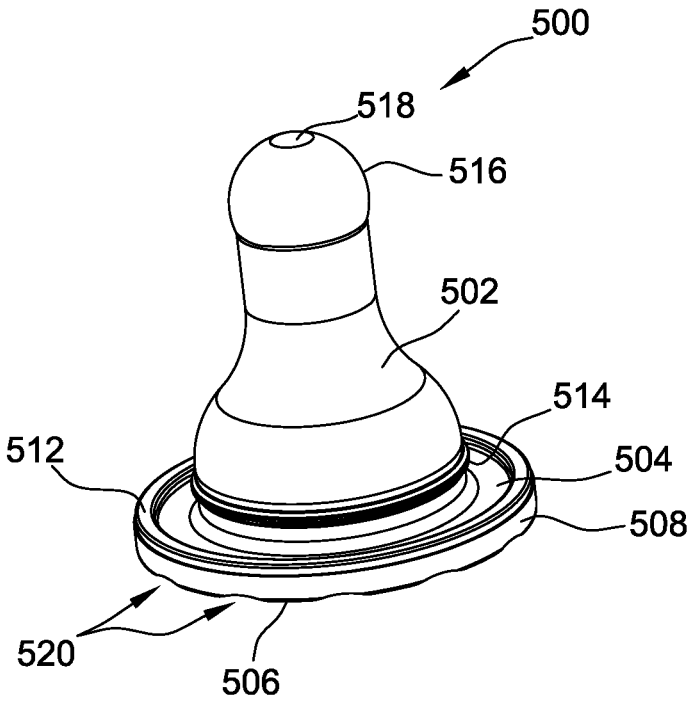
FIGS. 5A and 5B are perspectives of a nipple of the nursing bottle assembly of FIG. 1.
Figure 5B:
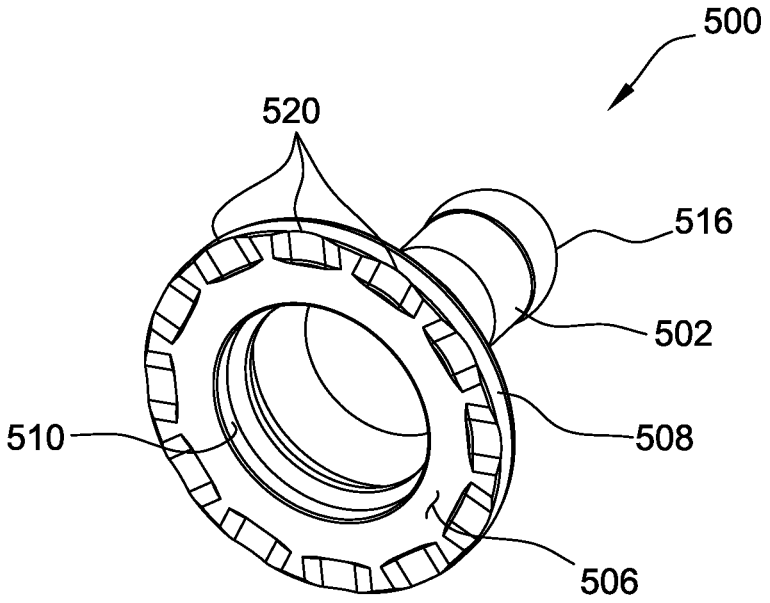

With reference to FIGS. 5A and 5B, the nipple 500 includes a nipple portion 502 and a transversely extending flange 504. The nipple flange 504 includes a bottom face 506 that extends from a generally circular outer edge 508 to a generally circular inner edge 510. A peripherally extending lip 512 projects up from the flange 504 generally adjacent the circular outer edge 508. In at least some embodiments, the nipple 500 does not include a peripherally extending lip 512. In the exemplary embodiment, the nipple portion 502 extends up from the flange 504 generally adjacent the circular inner edge 510 thereof. In some embodiments, the nipple portion 502 includes an annular projection 514 that projects radially outward. The nipple portion 502 also includes an outlet end 516 that includes an aperture 518 for dispensing liquid to the user. It is contemplated, however, that the nipple 500 can have different shapes and sizes than those illustrated and described herein without departing from the present invention.

Referring to FIG. 5B, the bottom face 506 of the nipple 500 has a plurality of vent features 520 extending radially inward from the circular outer edge 508 of the flange 504 in equal, circumferentially-spaced relationships to each other. The vent features 520 include a plurality of arcuate (in circumferential extension) channels that extend radially inward from the circular outer edge 508 of the flange 504. It is understood that in other embodiments the vent features 520 may be configured to have any other suitable shape. It is also contemplated that the vent features 520 may instead comprises radially extending slits formed in the bottom face 506 of the nipple 500.

Figure 9:
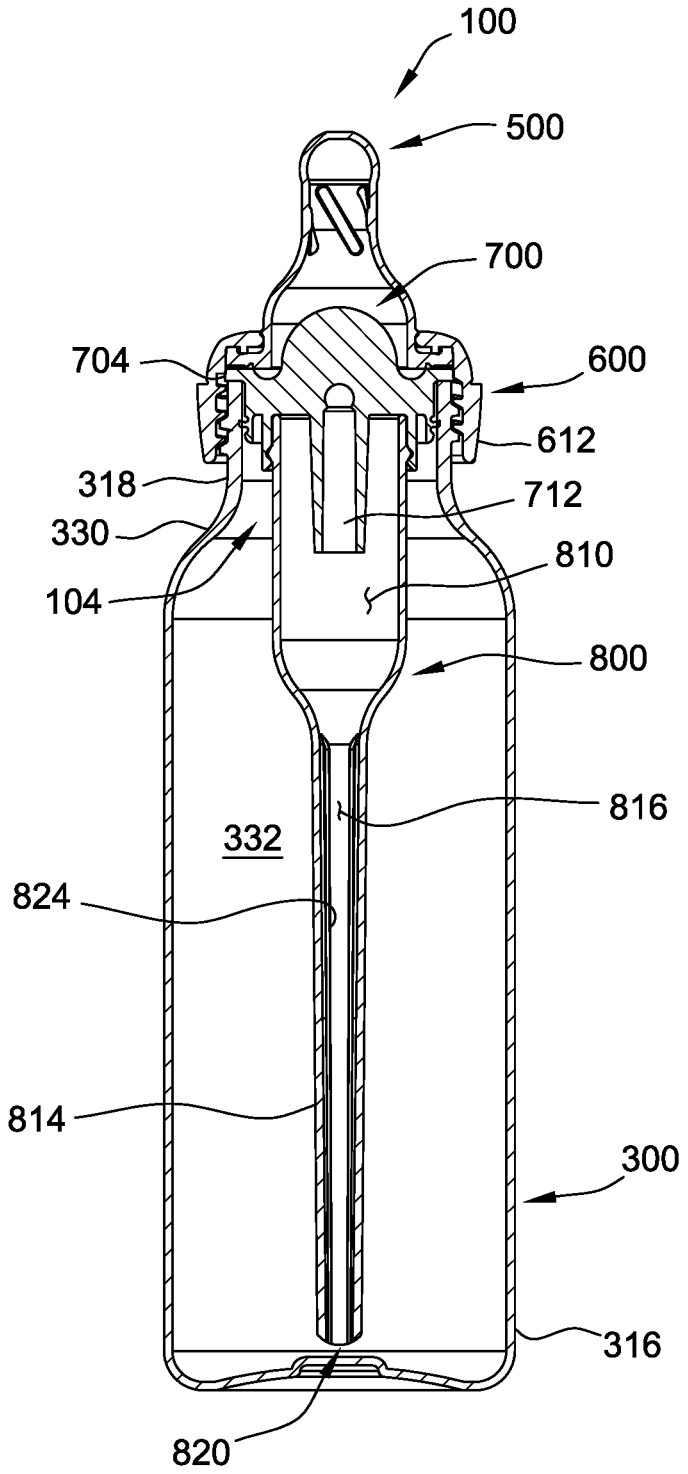
FIG. 9 is a perspective cross-section of the nursing bottle assembly of FIG. 1 in a first configuration including the vent assembly.
Figure 10:
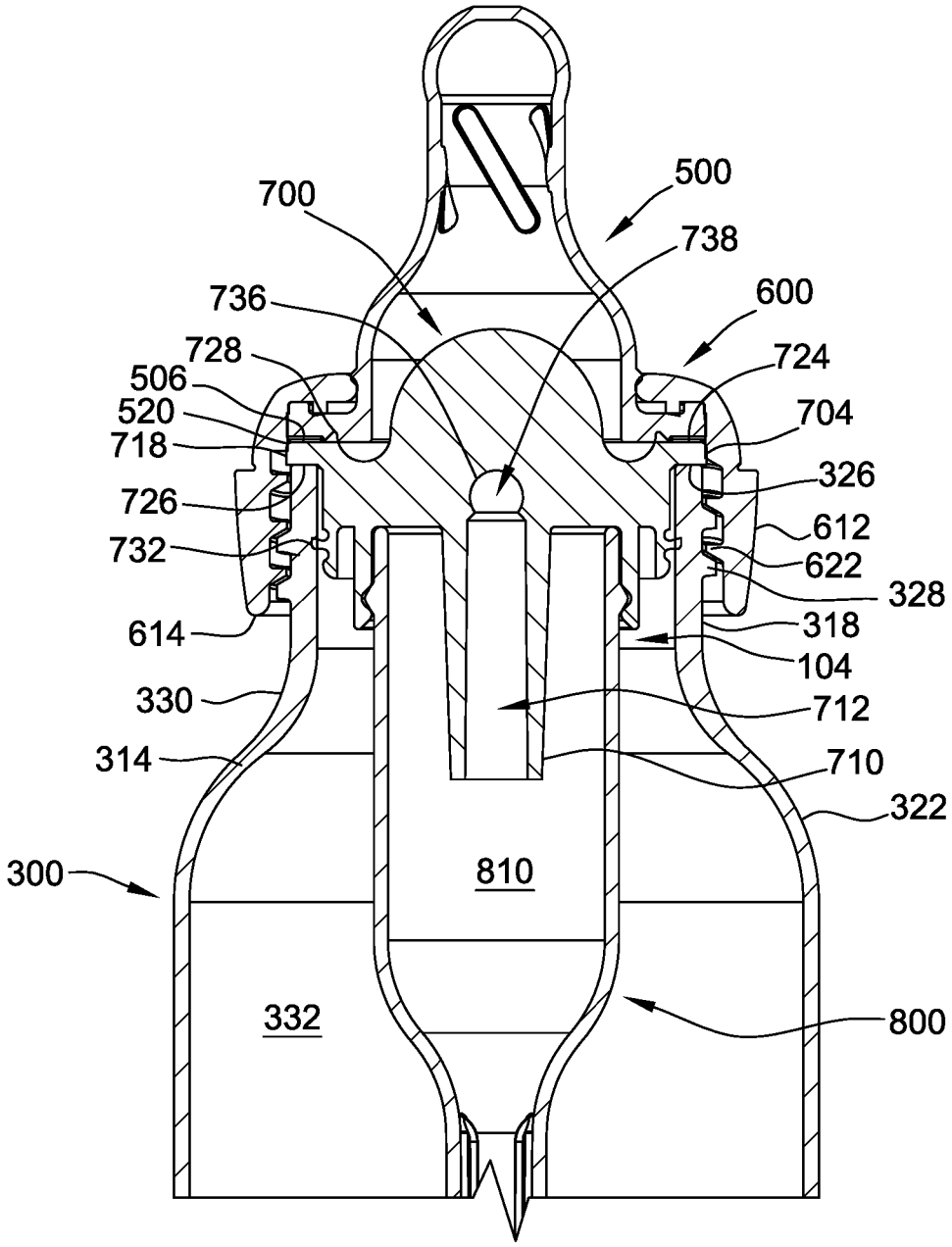
FIG. 10 is an enlarged cross-section of a portion of the nursing bottle assembly of FIG. 1 in the first configuration including the vent assembly.

The vent features 520 are suitably sized in length (e.g., in the radial direction), such that when the nipple 500 is used in the bottle assembly 100 of the embodiment of FIGS. 1 and 2, the vent features 520 do not extend radially inward of the vent insert 700 (described in detail herein) in a first configuration of the bottle assembly 100 (e.g., with the vent assembly 104 in place, as shown in FIGS. 9 and 10) so that the vent insert 700 seals against the bottom face 506 of the nipple 500 radially inward of the vent features 520. However, in a second configuration of the bottle assembly 100 (shown in FIG. 11), the bottom face 506 of the nipple 500 contacts the circular upper edge 326 of the bottle 300 with the vent features 520 extending radially inward of the upper edge 326 of the bottle 300 so that air can enter the bottle 300 via the vent features 520.

Figure 6A:
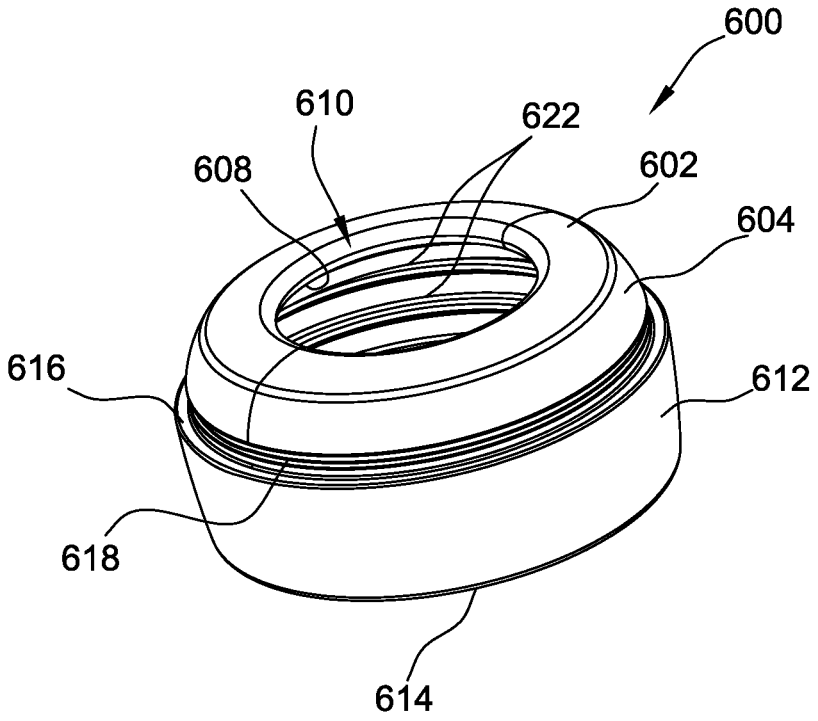
FIG. 6A is a perspective of a collar of the nursing bottle assembly of FIG. 1.
Figure 6B:
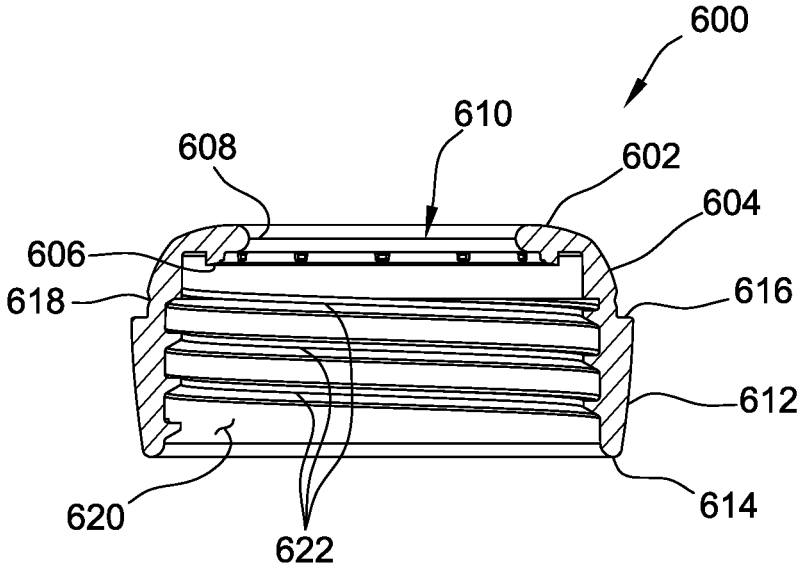
FIG. 6B is a cross-sectional view of the collar.

Referring to FIGS. 6A and 6B, the collar 600 has an annular top panel 602 and an upper convex sidewall 604 depending downward therefrom. The top panel 602 includes an annular projection 606 (as shown in FIG. 6B) that extends downward from the underside of the top panel 602 proximate a radially inner edge margin 608 of the top panel 602. The edge margin 608 and the annular projection 606 facilitate assembly of the nipple 500 (shown in FIGS. 5A and 5B) on the collar 600. To assemble the nipple 500 to the collar 600, the nipple 500 is pulled, nipple portion 502 first, up through a central opening 610 in the top panel 602 of the collar 600 until the edge margin 608 is positioned below the annular projection 514 of the nipple 500, and the annular projection 606 of the collar 600 is positioned radially inward of the peripheral lip 512 of the nipple 500. It is understood, however, that the nipple 500 and collar 600 may be configured other than as illustrated and still otherwise configured for assembly together for further assembly onto the bottle 300. It is also contemplated that in other embodiments the nipple 500 and collar 600 need not be capable of being held in assembly for conjoint assembly onto the bottle 300.

The collar 600 also includes a bottom tapered sidewall 612 that extends upward toward the upper convex sidewall 604 from a bottom edge 614 of the collar 600. The bottom tapered sidewall 612 tapers outward, forming an annular lip 616 where the upper convex sidewall 604 and the bottom tapered sidewall 612 meet. In the exemplary embodiment, the annular lip 616 is located at a generally central location between the bottom edge 614 and the annular top panel 602. The collar 600 includes an annular groove 618 formed in the upper convex sidewall 604 proximate the annular lip 616 for receiving the three inward extending tabs 410 of the cover 400 for releasable snap-fit connection. As a result, the cover 400 can be selectively secured to the collar 600. Furthermore, the collar 600 has an inner surface 620 with suitable internal threads 622 formed thereon for threaded engagement with the external threads 328 of the bottle 300 to releasably secure the collar 600 on the bottle 300.

Figure 11:
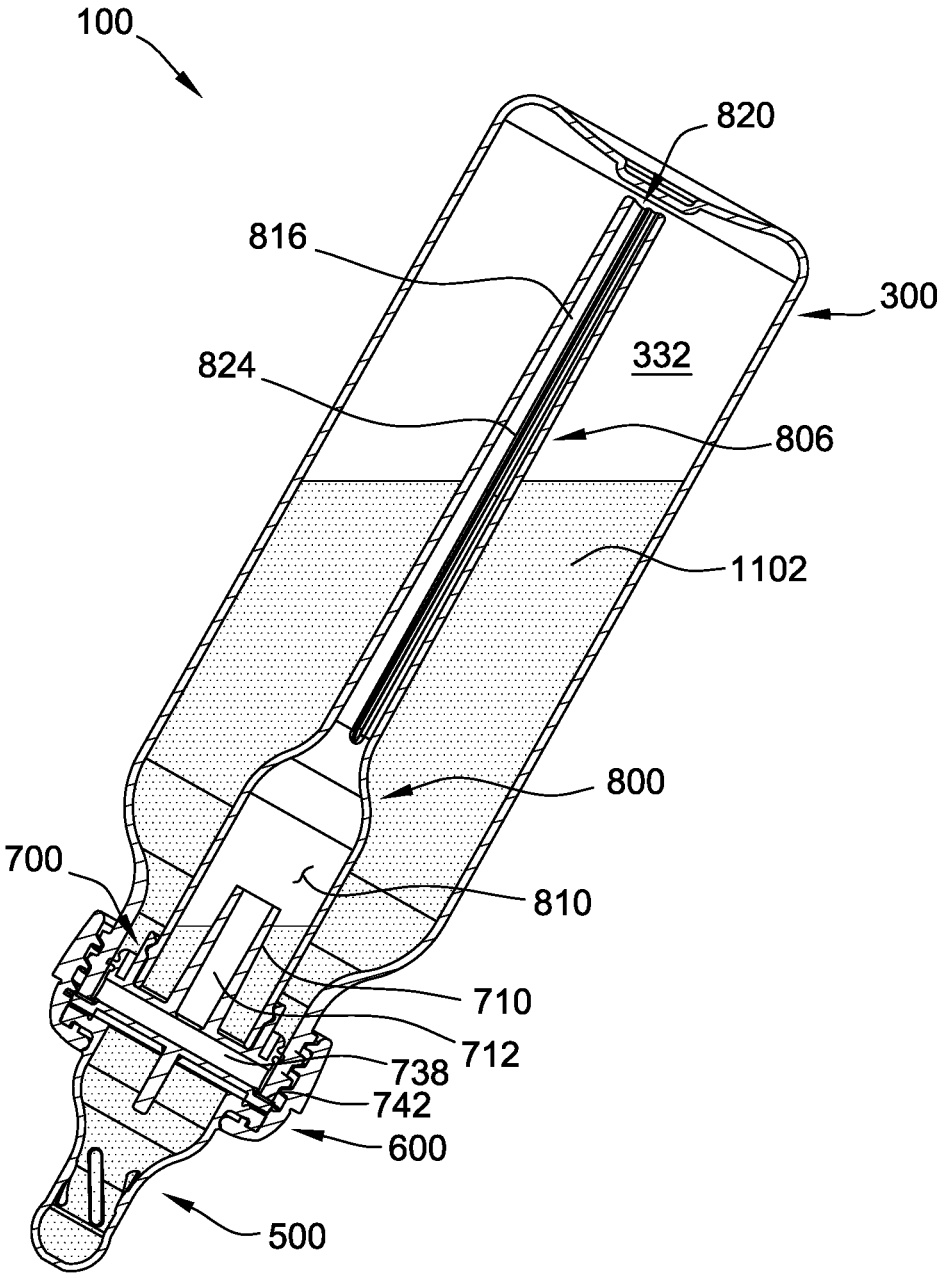
FIG. 11 is cross-section of the nursing bottle assembly of FIG. 1 in an inverted orientation, as used during feeding.

As shown in FIG. 2, in the first configuration, the bottle assembly 100 includes a vent assembly 104 to facilitate venting of the bottle assembly 100 during use. In FIG. 11, in a second configuration of the bottle assembly 100, the vent assembly 104 is omitted. The vent assembly 104 includes a vent insert 700 and a reservoir 800. The reservoir 800 is releasably attachable to the vent insert 700, such as by friction fit in a manner known in the art.

As shown in FIGS. 7A-7C and 10, the vent insert 700 generally includes an inner portion 702 and an outer portion 704. The inner portion 702 includes a transversely extending top wall 706, an annular sidewall 708 depending (e.g., longitudinally) from the top wall and an internal vent tube 710 also depending from the top wall 706 radially positioned within and more suitably centrally positioned in the annular sidewall 708. The internal vent tube 710 defines an air passage 712 in flow communication with the reservoir 800 (e.g., as seen best in FIG. 9). The depending sidewall 708 includes an annular groove 714 formed on an inner surface 716 thereof. With reference to FIG. 10, to connect the reservoir 800 with the vent insert 700, a sidewall 808 (shown in FIG. 8A) of the reservoir 800 is inserted into the vent insert 700 within the sidewall 708 of the inner portion 702 until a rib or bulge 812 of the reservoir 800 seats in the annular groove 714 of the vent insert inner portion sidewall 708.

The outer portion 704 of the vent insert 700 includes an annular flange wall 718 extending transversely of the vent insert and including an inner edge 720, an outer edge 722, a top surface 724 and a bottom surface 726. The bottom surface 726 of the flange wall 718 is configured to sit on the upper edge 326 of the bottle 300 when the bottle assembly 100 is fully assembled, e.g., as shown in FIG. 10. The outer portion 704 of the illustrated vent insert 700 further includes an annular rib 728 projecting up from the top surface 724 of the flange wall 718 adjacent the inner edge 720 thereof for sealing engagement with the nipple 500 upon assembly of the bottle 300. An annular sidewall 730 depends from the flange wall 718 of the outer portion 704 generally at the inner edge 720 of the flange wall and in radially spaced relationship with the annular sidewall 708 of the inner portion 702. The annular sidewall 730 includes an container engaging bulge or flap 732 extending radially outward from the outer surface of the sidewall 730 for frictionally and sealingly engaging the inner surface of the sidewall 314 of the bottle 300 (more particularly, an inner surface of the threaded portion 318 of the bottle 300) when the vent insert 700 is seated on the bottle 300.

The radially spaced relationship between the annular sidewall 730 of the outer portion 704 of the vent insert 700 and the annular sidewall 708 of the inner portion 702 of the vent insert defines an opening or gap 734 (see, e.g., FIG. 7A) therebetween through which the liquid contents of the bottle 300 can flow past the vent insert 700 into the nipple 500 during feeding, and from the nipple 500 back into the bottle 300 when feeding is stopped. The inner portion 702 of the vent insert 700 is held in assembly with the outer portion 704 at least in part by a transverse vent tube 736 defining a transversely extending vent 738. The vent tube 736 extends across the upper surface of the top wall 706 of the inner portion and bridges the gap 734 at both ends thereof to attach to the annular sidewall 730 of the outer portion. Openings 740 in the sidewall 730 allow the transverse vent 738 to be in fluid communication with ambient environment exterior of the bottle assembly 100. The transverse vent 738 is also open to the air passage 712 of the inner vent tube 710 to thereby provide fluid communication of the interior of the bottle 300 with the exterior of the bottle assembly 100 via the receptacle portion 810, inner vent tube air passage 712, and the transverse vent 738. One or more radially extending grooves 742 (FIG. 7B) are formed in the bottom surface 726 of the flange wall 718 from the inner edge 720 to proximate the outer edge 722 to complete the fluid communication between the exterior of the bottle 300 and the transverse vent 738. In such embodiments, the grooves 742 facilitate spacing a portion of the vent insert 700 from the upper edge 326 of the bottle 300 to facilitate air flow to the lateral vent 716 when the outer portion 704 is pressed against the upper edge 326.

Figure 7A:
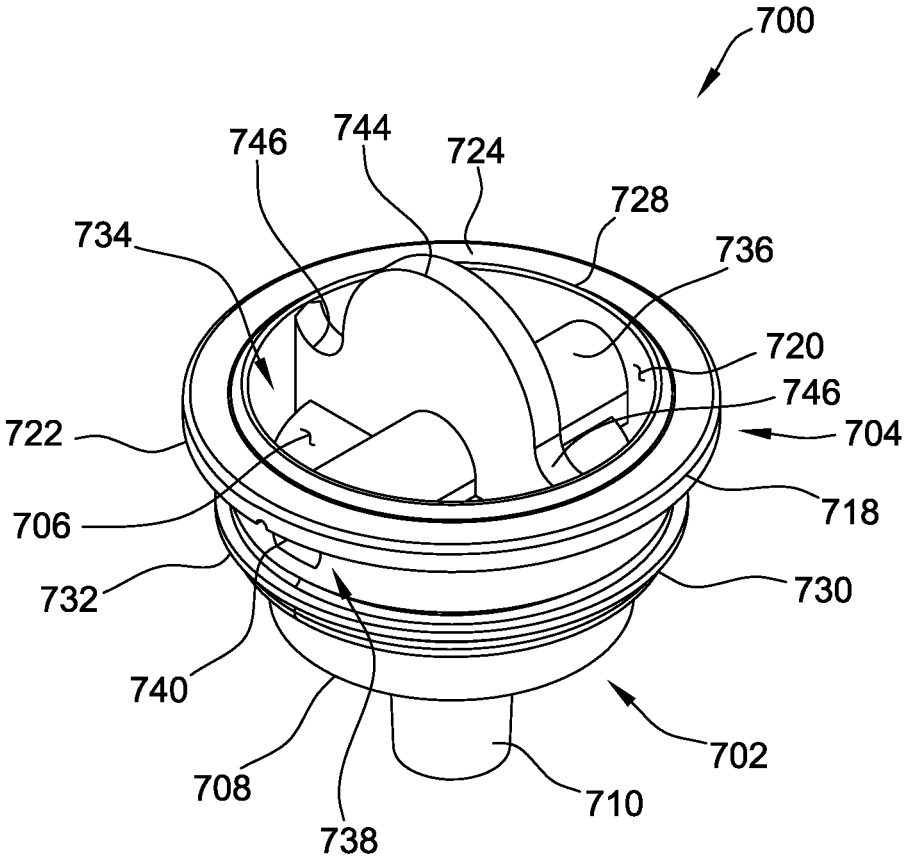
FIGS. 7A and 7B are perspectives of a vent insert of the nursing bottle assembly of FIG. 1.
Figure 7B:
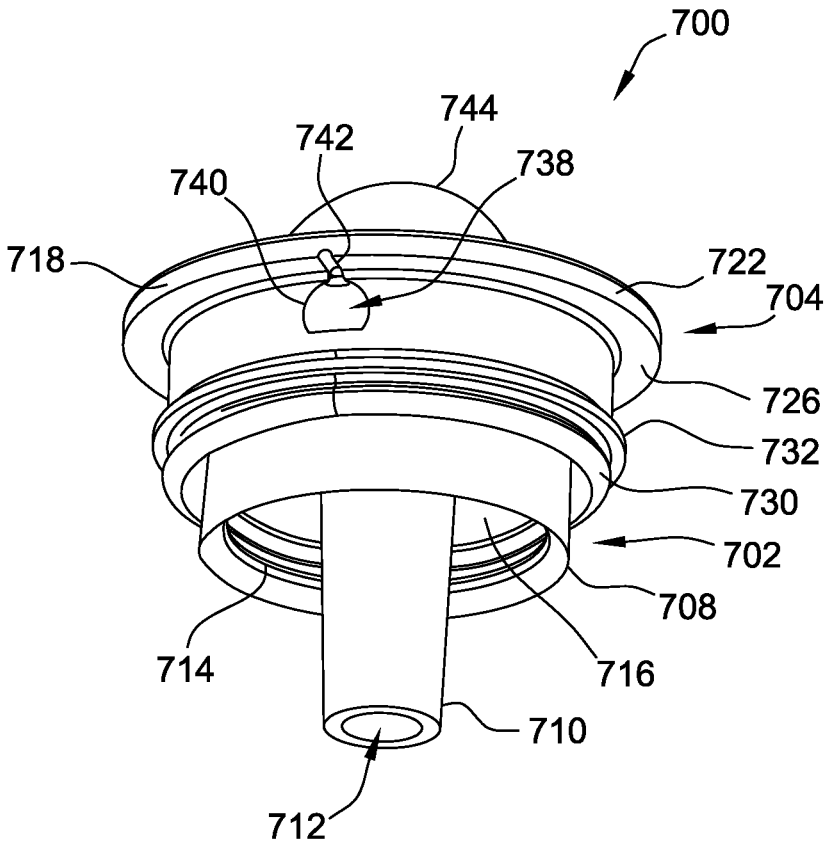
Figure 7C:
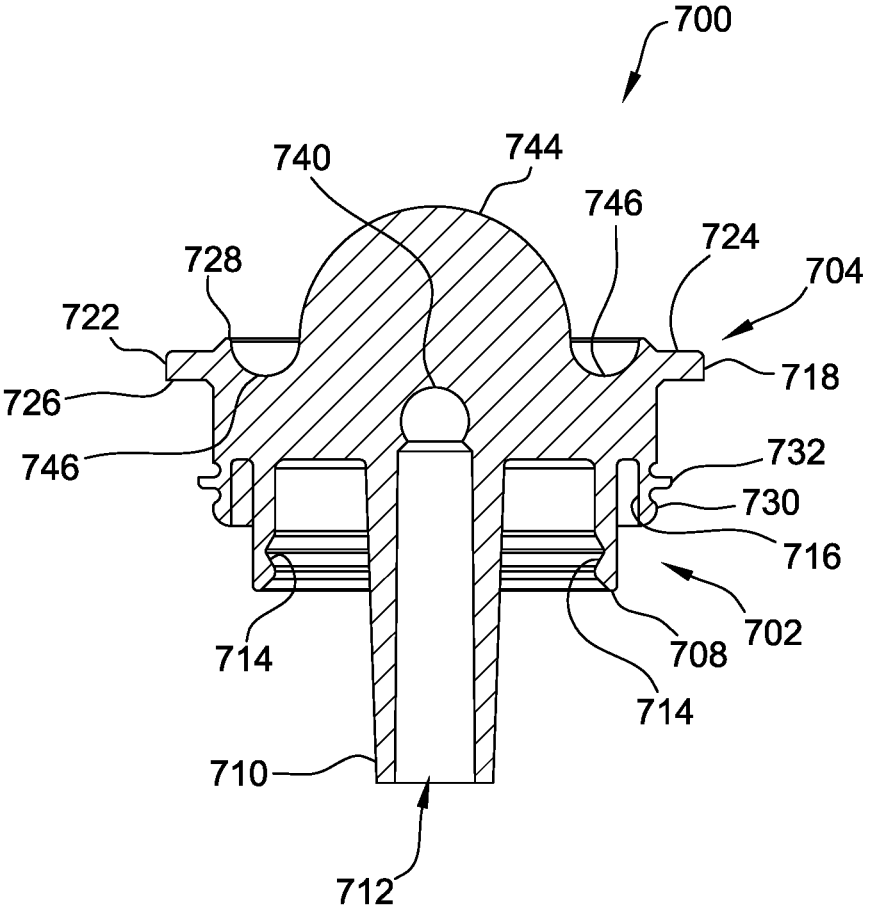
FIG. 7C is a cross-sectional view of the vent insert.

In the illustrated embodiment, the vent insert 700 further includes an upstanding grip tab 744 extending up from the top wall 706 of the inner portion 702 of the vent insert to facilitate ease of and disassembly of the vent insert 700 on or off of the bottle 300. As seen in FIGS. 7A and 7C, in the illustrated embodiment web portions 746 of the grip tab 744 (e.g., at both transverse ends thereof) span the gap 734 between the annular sidewall 730 of the outer portion 704 of the vent insert 700 and the annular sidewall 708 of the inner portion 702 of the vent insert to further connect the inner portion 702 of the vent insert with the outer portion 704 thereof. The webs 746 extending longitudinally downward between the outer portion sidewall 730 and the inner portion sidewall 708 to generally near the bottom of the top wall 706 of the inner portion 702 of the vent insert 700. However, it is understood that in other embodiments the grip tab 744 need not span the gap 734 to remain within the scope of this invention.

Figure 8A:
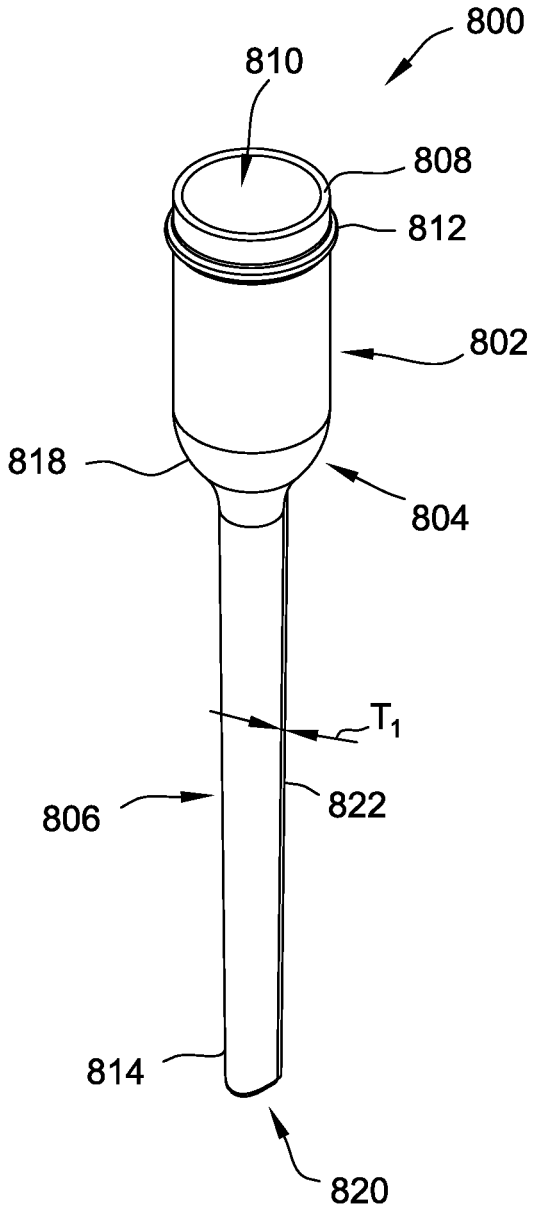
FIG. 8A is a perspective of a reservoir of a vent assembly of the nursing bottle assembly of FIG. 1.
Figure 8B:
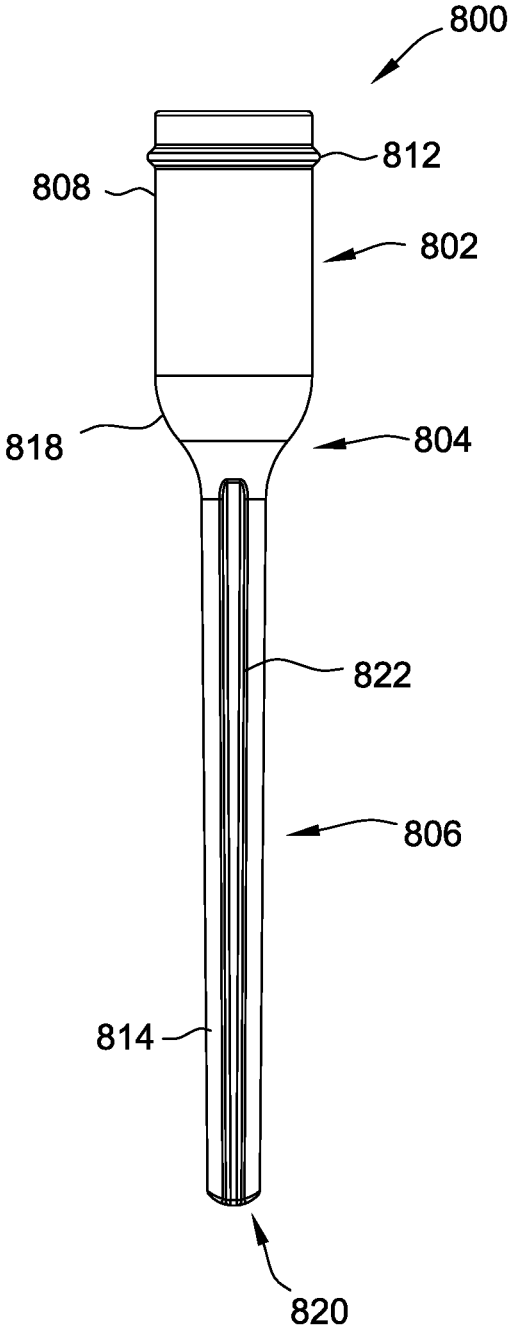
FIG. 8B is a side view of the reservoir.

With reference to FIGS. 8A-8D, the reservoir 800 includes a top portion 802, a middle portion 804, and a vent tube 806. The top portion 802 includes a generally cylindrical sidewall 808 that defines a receptacle portion 810 therein. In addition, the top portion 802 includes an annular bulge 812 that projects radially outward and extends around the top portion 802 proximate a top of the reservoir 800. The bulge 812 is spaced from the top of the reservoir 800 a predefined distance and configured to engage the annular groove 714 of the vent insert 700 to provide a latch and catch type connection between the receptacle portion 810 and the vent insert 700. The vent tube 806 includes a generally cylindrical sidewall 814 that has a smaller diameter than the sidewall 808 of the top portion 802. The sidewall 814 of the vent tube 806 defines a tubular passage 816 that is in fluid communication with the receptacle portion 810. The middle portion 804 includes a tapered sidewall 818 that extends between the vent tube sidewall 814 and the top sidewall 808. The vent tube 806 also includes an air outlet 820 at an end of the passage 816 opposite the receptacle portion 810. As shown in FIG. 8A, the vent tube 806 tapers along its length, for example, and without limitation, at a draft angle of approximately 5 degrees to facilitate molding of reservoir 800.

Figure 8C:
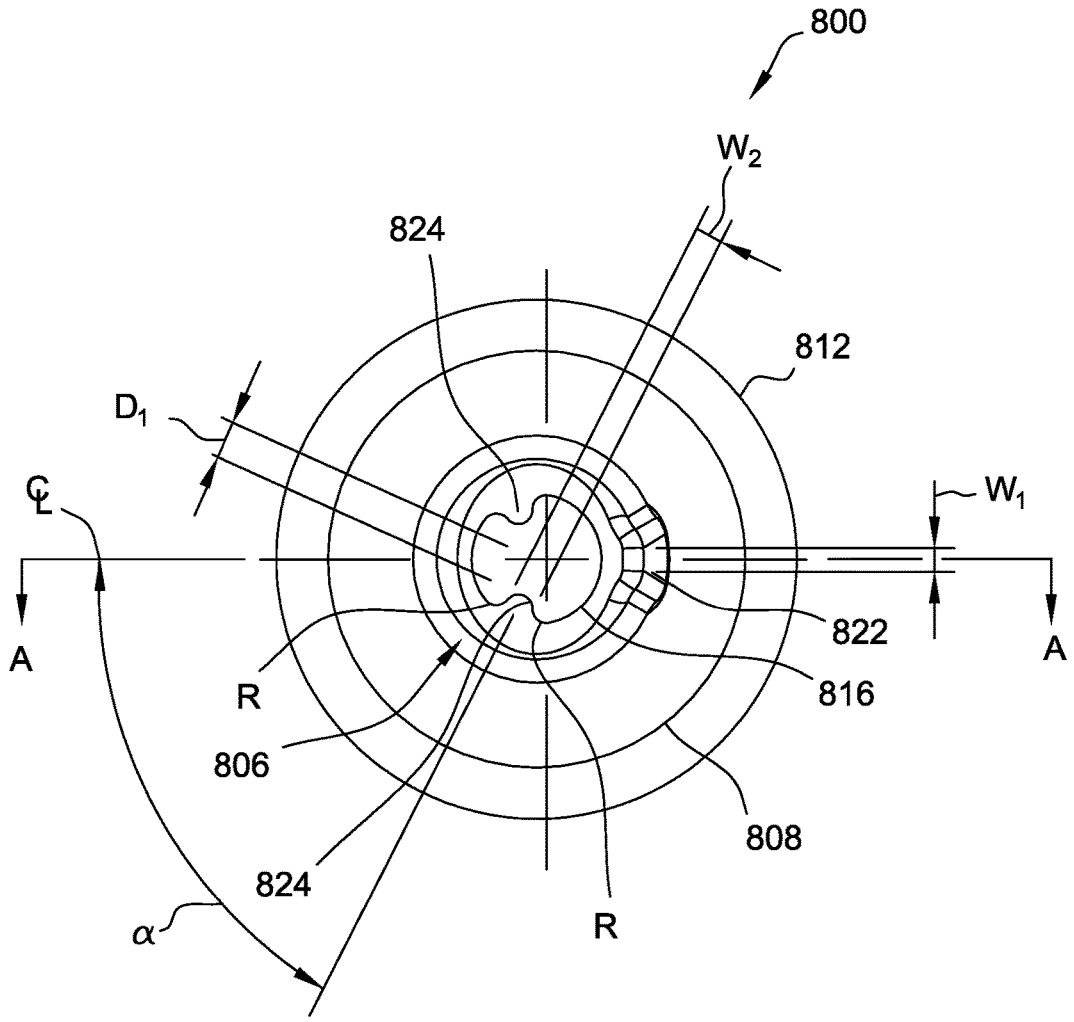
FIG. 8C is a bottom view of the reservoir.
Figure 8D:
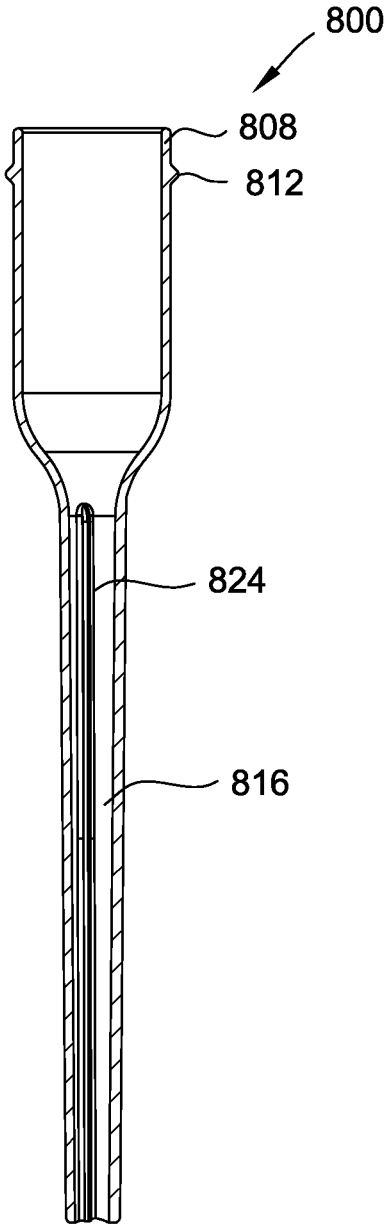
FIG. 8D is a cross-sectional view of the reservoir.

The reservoir 800 includes an external rib 822 (best shown in FIGS. 8B and 8C) that extends along the outer surface of the sidewall 814 of the vent tube 806. The external rib 822 extends from the air outlet 820 to the middle portion 804 of the reservoir 800. The external rib has a thickness $T_1$ that is substantially equal along the length of the vent tube 806. For example, in one embodiment, the thickness $T_1$ is about 0.25 millimeters (mm) (0.01 inches (in.)). Alternatively, the thickness $T_1$ is any amount that enables the external rib to function as described herein. The external rib also has a varying width. As shown in FIG. 8C, the external rib 822 is generally centered about center line A-A, and has a width $W_1$ at the air outlet end 820. The width $W_1$ tapers outward along the length of the vent tube 806, for example, and without limitation, at a draft angle of approximately 5 degrees to facilitate molding of reservoir 800. In the exemplary embodiment, the external rib 822 facilitates counteracting warping of the vent tube 806 during a molding process of the reservoir 800.

In the illustrated embodiment, the reservoir 800 includes two internal ribs 824 that extend along the inner surface of the sidewall 814 of the vent tube 806 to the middle portion 804 of the reservoir 800. The internal ribs 824 are symmetrical to each other about center line A-A in FIG. 8C and are substantially the same, thus one rib will be described herein, with the description being applicable to the other rib. As shown in FIG. 8C, internal rib 824 is centered about a radial line located at an angle of approximately 60 degrees with respect to center line A-A, the radial line extending through a central axis of reservoir 800. The internal rib 824 has a generally semicircular cross-section, i.e., a full radius, with a width $W_2$ that is substantially the same along its length. For example, in one embodiment, the width $W_2$ is about 1.01 mm (0.04 in.). The internal rib 824 has a fillet of radius R where it intersects the inner surface of the sidewall 814. For example, in one embodiment, the radius R of the fillet is about 0.51 mm (0.02 in.), thereby providing a smooth transition between the rib 824 and the inner surface of the sidewall 814. In addition, the internal rib 824 extends radially inward from the inner surface of the sidewall 814. For example, as shown in FIG. 8C, the internal rib 824 extends radially inward to a distance $D_1$ from the center axis of the reservoir 800. In one embodiment, the distance $D_1$ is about 1.40 mm (0.06 in.). The internal ribs 824 facilitate defining a generally hourglass shaped tubular passage 816 within the vent tube 806.

As illustrated in FIGS. 9 and 10, the collar bottom tapered sidewall 612, the outer portion 704 of the vent insert 700, and the top threaded portion 318 of the bottle 300 are suitably sized relative to each other to facilitate operation of the bottle assembly 100 in two different configurations: the first configuration (as shown in FIG. 10) including the vent assembly 104; and the second configuration (not shown) in which the vent assembly 104 is omitted. For example, the length (or height in the orientation of the figures herein) of the top threaded portion 318 of the bottle 300 (e.g., from the upper edge 326 of the bottle 300 to the upper portion 322 or the region 330 where the top threaded portion 318 widens outward to the base portion 316 of the bottle 300) is sufficient to accommodate the bottom tapered sidewall 612 of the collar 600 in the second configuration; i.e., when the vent assembly 104 is omitted. More particularly, when the vent assembly 104 is omitted, the collar 600 is configured to tighten down an additional vertical distance approximately equal to a height of the perimeter wall 718 of the outer portion 704 of the vent insert 700, such that the bottom face 506 of the nipple 500 seats on the upper edge 326 of the bottle 300.

This may be more readily understood with reference to FIGS. 7A-7C, 9, and 10. As shown, the vent insert 700 is constructed such that the height of the outer portion 704 (more specifically, the thickness of the flange wall 718) is relatively narrow compared to the rest of the vent insert 700. This is achieved by, among other features, providing the channel 738 of the transverse vent tube 736 below the outer portion 704 such that the channel 738 (or, alternatively, a majority of the channel 738) ultimately sits below the upper edge 326 of the bottle 300 when the vent insert 700 is in the assembled position. Accordingly, the thickness (e.g., height) of the flange wall 718 of the outer portion 704 may be narrower than otherwise would be necessary to accommodate the channel 738 of the transverse vent tube 736 if the channel 738 were provided above the upper edge 326 of the bottle 300 when assembled (as is common for many known vent assemblies). Rather, the flange wall 718 of the vent insert 700 must only be tall enough to accommodate the one or more grooves 742 (shown in FIG. 7B).

Such relative dimensions of the vent insert 700 (i.e., the narrowness of the flange wall 718 relative to the other features of vent insert 700) facilitates assembling the bottle assembly 100 in two discrete configurations, while eliminating or minimizing leakage from the bottle assembly 100 in each configuration. For example, and as best shown in FIG. 10, in the first configuration, the bottle assembly 100 includes the vent assembly 104. In this configuration, the vent assembly 104 is inserted into the bottle 300 such that the bottom surface 726 of the flange wall 718 of the vent insert 700 seats down against the upper edge 326 of the bottle 300, and such that the container engaging bulge 732 frictionally and sealingly engages the inner surface of the sidewall 314 of the bottle 300. After the vent assembly 104 is inserted in such a position, the collar 600 is attached to the bottle 300 by threadably engaging the internal collar threads 622 with the external threads 328 of the top threaded portion 318 and rotating the collar 600 to twist the collar down onto the bottle 300. As the collar 600 is tightened onto the bottle 300, the bottom face 506 of the nipple 500 is urged against the top surface 724 of the flange wall 718 and against the annular rib 728 of the vent insert 700 to seal the nipple 500 against the vent assembly 104. Concurrently, the bottom surface 726 of the flange wall 718 of the vent insert 700 is urged against the upper edge 326 of the bottle 300 to position the vent assembly 104 on the bottle 300.

In this configuration, the collar threads 622 engage the threads 328 of the top threaded portion 318 such that no threads are visible below the collar 600. More particularly, and as shown in FIGS. 9 and 10, the collar bottom tapered sidewall 612 is sufficiently long such that in the first configuration the bottom edge 614 of the bottom tapered sidewall 612 extends below the lowermost external thread 328 of the top threaded portion 318 so that no external threads 328 are visible when the collar 600 is secured to the bottle 300. Furthermore, because the collar 600 securely seats the nipple 500 and the vent assembly 104 to the upper edge 326 of the bottle 300, fluid leakages are minimized or reduced during use of the bottle assembly 100.

Furthermore, in the exemplary embodiment, the annular rib 728 provided on the vent insert 700 serves as a seal between the vent features 520 and the liquid chamber 332 of the bottle 300 such that the vent features 520 are not in fluid communication with the liquid chamber 332 when the bottle assembly 100 is in the first configuration. More particularly, and returning to FIG. 5B, the vent features 520 provided on the bottom face 506 of the nipple flange 504 extend only partially in from the outer edge 508 of the nipple 500 (i.e., the vent features 520 do not extend all the way to an inner edge 510 of the nipple 500). In addition, the annular rib 728 of the vent insert 700 is located radially inward of the innermost portion of the vent features 520. Thus, the annular rib 728 seals the liquid chamber 332 of the bottle 300 from the vent features 520, such that the vent features 520 are not in fluid communication with the liquid chamber 332 when the bottle assembly 100 is in the first configuration. Venting of the bottle 300 during use, as further described below is accomplished via the vent assembly 104, and, more particularly, via the grooves 742 and the lateral vent 716 of the vent insert 700.

With reference to FIG. 11, in operation, a liquid 1102, such as water, juice, or milk, is placed into the liquid chamber 332 of the bottle 300. The liquid partially fills the vent tube 806 by entering through the air outlet 820 at an end of the passage 816. When the bottle assembly 100 is inverted for feeding, a portion of the liquid 1102 is trapped in the vent tube 806 and flows into the receptacle portion 810 of the reservoir 800. The internal vent tube 710 extends into the reservoir 800 such that the air passage 712 in flow communication with the receptacle portion 810 above a level of the liquid 1102 to facilitate reducing the possibility of the liquid 1102 entering the air passage 712 when the bottle assembly 100 is inverted. As shown in FIG. 11, when inverted, no additional liquid 1102 can enter the vent tube 806, and air is free to enter the liquid chamber 332 of the bottle 300 by flowing through the one or more grooves 742, the channel 738, and the air passage 712 into the receptacle portion 810 of the reservoir 800. The air then travels from the receptacle portion 810 into the liquid chamber 332 via the passage 816. Thus, the liquid chamber 332 of the bottle 300 remains at atmospheric pressure during feeding, and air replaces the volume of the liquid 1102 sucked through the nipple 500, preventing the creation of a partial vacuum that would make it difficult for an infant to draw the liquid 1102 from bottle assembly 100.

When feeding is stopped and the bottle assembly 100 is turned upright, the liquid 1102 in the receptacle portion 810 of the reservoir 800 flows back down the vent tube 806. In addition, the liquid 1102 in the bottle 300 returns to the lower portion of the bottle such that a portion of the liquid 1102 flows up into the vent tube 806 through the air outlet 820 at an end of the passage 816 of the vent tube 806. As described earlier herein, with some known bottles, air may become trapped in the vent tube between the liquid 1102 flowing back into the bottle 300 from the receptacle portion 810 and the liquid 1102 flowing into the vent tube from the bottle 300, thereby forming an air bubble in the vent tube. In the illustrated embodiment, the internal ribs 824 of the reservoir 800 facilitate the flow of liquid 1102 from the receptacle portion 810 back into the bottle 300 without the formation of air bubbles in the vent tube 806. In particular, the internals ribs 824 facilitate defining an hourglass-shaped cross-section of the passage 816 of the vent tube 806, thereby forming the passage 816 with a groove defined therein. When the vent tube 806 is turned vertically, the liquid 1102 extends along the groove and the air or air bubble in the vent tube 806 rises easily to the receptacle portion 810 of the reservoir 800 under gravity. In addition, the internals ribs 824 interact with the surface tension of the liquid 1102 to inhibit the formation of air bubbles within the vent tube 806.

The components as described herein may provide additional benefits for users of existing bottle assemblies and/or existing vent assemblies. For example, many current users may already own several bottles configured to operate with one or more of the known collar assemblies and/or vent assemblies. These bottles may include, e.g., external threads configured to be used with a known collar assembly and/or a known vent assembly. However, because the reservoir 800 of the vent assembly 104 is constructed as described herein, it may be used to replace known reservoirs, while still providing the desired venting of the bottle. Accordingly, a user may be able to use the collar 600 and/or the vent assembly 104 described herein with their currently owned bottles. Furthermore, a manufacturer or the like of the bottles may continue to manufacture the bottles using a same design as for known bottle assemblies, while providing the bottle assemblies 100 with the novel reservoir 800 and/or vent assembly 104 described herein such that the improved bottle assembly 100 reduces or eliminates bubble formation in the vent tube, and potential fluid leakage, during use of the bottle assembly 100.

Exemplary embodiments of an apparatus, system, and methods for a bottle assembly are described above in detail. The apparatus, system, and methods described herein are not limited to the specific embodiments described, but rather, components of apparatus, systems, and/or steps of the methods may be utilized independently and separately from other components and/or steps described herein. For example, the methods may also be used in combination with other bottle apparatuses, systems, and methods, and are not limited to practice with only the apparatuses, systems, and methods described herein. Rather, the exemplary embodiments can be implemented and utilized in connection with many bottle assembly applications.

Although specific features of various embodiments of the disclosure may be shown in some figures and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

As various changes could be made in the above embodiments without departing from the scope of the disclosure, it is intended that all matter contained in the above description and shown in the accompanying figures shall be interpreted as illustrative and not in a limiting sense.

What is claimed is:

1. A feeding assembly comprising:

a container having an open top and defining a liquid chamber therein for holding a liquid;

a collar assembly defining a closure for the open top of the container upon assembly with the container, the collar assembly comprising a collar releasably securable to the container and a nipple coupled to the collar and having an opening through which liquid exits the feeding assembly during feeding; and a vent assembly comprising at least one vent, wherein the vent assembly is positionable at least in part on the open top of the container and configured to facilitate venting of the container through the at least one vent to atmosphere as liquid exits the feeding assembly during feeding, the vent assembly being disposed intermediate the container and the nipple and comprising a vent tube through which air is able to flow from external of the feeding assembly to the container during feeding, the vent tube comprising an internal rib extending longitudinally of the feeding assembly and configured to inhibit the formation of air bubbles within the vent tube and facilitate the flow of liquid from the vent assembly back into the container when feeding is ceased and the container is oriented generally upright.

2. The feeding assembly set forth in claim 1, wherein the vent tube comprises at least two internal ribs extending longitudinally of the feeding assembly.

3. The feeding assembly set forth in claim 2, wherein the at least two internal ribs are fabricated symmetrical to each other about a plane extending through a center axis of the vent tube.

4. The feeding assembly set forth in claim 1, wherein the internal rib comprises a generally semicircular cross-section.

5. The feeding assembly set forth in claim 4, wherein the internal rib comprises a cross-sectional radius of 0.02 inches.

6. The feeding assembly set forth in claim 1, wherein an intersection of the internal rib and an inner surface of the vent tube comprises a fillet.

7. The feeding assembly set forth in claim 6, wherein the fillet comprises a radius of 0.02 inches.

8. The feeding assembly set forth in claim 1, wherein the internal rib extends radially inward from an inner surface of the vent tube.

9. The feeding assembly set forth in claim 8, wherein the internal rib extends radially inward to a distance from a center axis of the vent tube of 0.06 inches.

10. A feeding assembly comprising:

a container having an open top and defining a liquid chamber therein for holding a liquid;

a collar assembly defining a closure for the open top of the container upon assembly with the container, the collar assembly comprising a collar releasably securable to the container and a nipple coupled to the collar and having an opening through which liquid exits the feeding assembly during feeding; and a vent assembly comprising at least one vent, wherein the vent assembly is positionable at least in part on the open top of the container and configured to facilitate venting of the container through the at least one vent to atmosphere as liquid exits the feeding assembly during feeding, the vent assembly being disposed intermediate the container and the nipple and comprising a vent tube through which air is able to flow from external of the feeding assembly to the container during feeding, the vent tube comprising an internal rib extending longitudinally of the feeding assembly and configured to facilitate the flow of liquid from the vent assembly back into the container when feeding is ceased and the container is oriented generally upright, wherein the internal rib is centered about a radial line located at an angle of approximately 60 degrees with respect to a center line of the vent tube, the radial line extending through a center axis of the vent tube.

11. The feeding assembly set forth in claim 10, wherein the vent tube comprises at least two internal ribs extending longitudinally of the feeding assembly.

12. The feeding assembly set forth in claim 11, wherein the at least two internal ribs are fabricated symmetrical to each other about a plane extending through a center axis of the vent tube.

13. The feeding assembly set forth in claim 10, wherein the internal rib comprises a generally semicircular cross-section.

14. The feeding assembly set forth in claim 13, wherein the internal rib comprises a cross-sectional radius of 0.02 inches.

15. The feeding assembly set forth in claim 10, wherein an intersection of the internal rib and an inner surface of the vent tube comprises a fillet.

16. The feeding assembly set forth in claim 15, wherein the fillet comprises a radius of 0.02 inches.

17. A vent assembly for use with a feeding assembly, the feeding assembly including a container having an open top and defining a liquid chamber therein for holding a liquid, the vent assembly comprising:

a vent insert comprising at least one vent, wherein the vent insert is positionable at least in part on the open top of the container and configured to facilitate venting of the container through the at least one vent to atmosphere as liquid exits the feeding assembly during feeding, the vent insert further comprising an inner portion having a transversely extending top wall and an annular sidewall depending longitudinally from the top wall, the vent insert further comprising an outer portion comprising a transversely extending annular flange wall and an annular sidewall depending from the annular flange wall in a radially spaced relationship with the annular sidewall of the inner portion, the annular flange wall including an inner edge, an outer edge, a top surface, and a bottom surface; and a reservoir connected to the vent insert and comprising a receptacle portion and a vent tube depending from the receptacle portion and in fluid communication with the receptacle portion, the vent tube comprising an internal rib extending longitudinally of the feeding assembly and configured to inhibit the formation of air bubbles within the vent tube during use with the feeding assembly.

18. The feeding assembly set forth in claim 17, wherein the vent tube comprises at least two internal ribs extending longitudinally of the feeding assembly.

19. The feeding assembly set forth in claim 18, wherein the at least two internal ribs are fabricated symmetrical to each other about a plane extending through a center axis of the vent tube.

20. The feeding assembly set forth in claim 17, wherein the internal rib is centered about a radial line located at an angle of approximately 60 degrees with respect to a center line of the vent tube, the radial line extending through a center axis of the vent tube.

* * * * *